US008164265B2

(12) United States Patent
Shinogi

(10) Patent No.: US 8,164,265 B2
(45) Date of Patent: Apr. 24, 2012

(54) LIGHTING METHOD OF MICROWAVE EXCITATION DISCHARGE LAMP

(75) Inventor: Akira Shinogi, Chino (JP)

(73) Assignee: Orc Manufacturing Co., Ltd., Tokyo (JP)

( * ) Notice: Subject to any disclaimer, the term of this patent is extended or adjusted under 35 U.S.C. 154(b) by 480 days.

(21) Appl. No.: 12/329,535

(22) Filed: Dec. 5, 2008

(65) Prior Publication Data

US 2009/0195160 A1 Aug. 6, 2009

(30) Foreign Application Priority Data

Jan. 31, 2008 (JP) ..... 2008-020068

(51) Int. Cl.
*H01J 1/02* (2006.01)

(52) U.S. Cl. ..... 315/39.51; 315/248; 315/39; 315/291; 315/276; 315/360

(58) Field of Classification Search ..... 315/39, 315/98, 207, 219, 224, 248, 291, 307
See application file for complete search history.

(56) References Cited

U.S. PATENT DOCUMENTS

| | | | | |
|---|---|---|---|---|
| 5,438,242 | A * | 8/1995 | Simpson | 315/219 |
| 6,720,733 | B2 * | 4/2004 | Suzuki et al. | 315/39.51 |

FOREIGN PATENT DOCUMENTS

| | | | |
|---|---|---|---|
| JP | 5-251174 | A1 | 9/1993 |
| JP | 07-014672 | A1 | 1/1995 |
| JP | 2003-068490 | A1 | 3/2003 |
| JP | 2003-100440 | A1 | 4/2003 |
| JP | 2004-200051 | A1 | 7/2004 |

* cited by examiner

*Primary Examiner* — Douglas W Owens
*Assistant Examiner* — Jonathan Cooper
(74) *Attorney, Agent, or Firm* — patenttm.us

(57) ABSTRACT

To prevent the continuation of the abnormal state occurring immediately after the lighting start of the electrodeless discharge lamp excited by a DC driven magnetron and to recover promptly from the abnormal state at the steady state period. Lighting start of an electrodeless discharge lamp is performed in soft start mode. Increasing the power supply to the magnetron gradually, the lamp is turned into a lighting state for longer time than the time for the luminescence medium to evaporate fully absorbing microwave. At that period, the output of DC power supply is periodically cut off momentarily, resetting the abnormal state. Then, stable DC power is supplied. At the steady state period, the anode current of the magnetron is controlled to be constant. When rise of the operation voltage of the magnetron is detected, the output of DC power supply is cut off momentary to recover to the steady state.

9 Claims, 6 Drawing Sheets

Operation mode of magnetron

Coupling mode of magnetron

State diagram

LIGHTING METHOD OF MICROWAVE EXCITATION DISCHARGE LAMP

FIELD OF INVENTION

The present invention relates to a method of lighting a microwave excitation discharge lamp, especially to a method of lighting an electrodeless discharge lamp to emit high-power UV radiation with applying almost ripple-free DC power.

BACKGROUND OF THE INVENTION

An electrodeless discharge lamp does not need electrodes in the lamp bulb as it is ignited with applying a microwave out of a magnetron. Therefore, its operation life is long because of no decay of electrodes, no contamination of enclosed gas and no contamination of lamp envelope of quartz glass or so. The focus of the electrodeless discharge lamp is smaller than an electroded discharge lamp because of its small inner diameter. The electrodeless discharge lamp should be held in an adequate microwave cavity resonator and the magnetron microwave should be applied through an adequate waveguide (guide tube or coaxial cable) to the lamp with an antenna situated in the cavity resonator in order to apply microwave power to the electrodeless discharge lamp efficiently.

Several thousand volts and several hundred milliamperes are required to drive a magnetron. The magnetron is ordinarily driven by rippling power rectified from commercial frequency power. A power source device of this kind has advantages of low cost manufacturing and few breakdowns because of its simple structure. And also, magnetron drive power can be controlled according to required illumination in a range from 35% to 100% of full power.

The electrodeless discharge lamp ignited by a magnetron microwave is utilized at film processing in FPD industry and wiredraw process of optical fibers and also UV coating. Coating material used in these processes is generally called photosensitive resin (photopolymer). Photosensitive resin will solidify, dry or harden with irradiation of more than certain quantity of UV radiation. And also, UV radiation irradiation can raise the removability or adhesion. The processes of low-energy consumption and less dissolvent consumption are required for ecological protection (e.g., exhaust control of CO2 or VOC). The process using photosensitive resin does not need dissolvent basically. Photosensitive resin is processed with UV radiation instead of heat. UV process needs very little energy consumption and dissolvent consumption compared to heat processing.

In recent years, there is a strong requirement to raise manufacturing line speed. And also, there is a strong requirement for stability to manufacture stable products. The speed of wiredraw line of optical fiber is 1000 m/min. The film processing speed is from 100 to 200 m/min. Uniform products can hardly be yielded because of local fluctuation of UV radiation irradiation and high speed of the manufacturing line in case of using rippled power source in these high-speed processes. The discharge lamp blinks at an interval from about 8 msec to 10 msec according to a frequency of 50 Hz or 60 Hz and gives rise to no-irradiation periods of UV radiation. Then inequality of irradiation on products is caused and uniform products are not available. And also, the discharge lamp lifetime is shortened because blinking is repeated twice at 50 Hz or 60 Hz in frequency.

Then, DC power is introduced to drive a magnetron. The magnetron can be driven with DC power of fewer ripples applying pulse-mode switching power supply. Consequently, microwave power intensity becomes stable. Irradiation becomes constant and good quality light can be available when such power is applied to the discharge lamp. When the discharge lamp is driven by a conventional ripple power supply at the mean power equal to DC drive, the peak output of such a magnetron is larger than that of the DC driven magnetron by reason of the long stop period of the magnetron driven by the ripple power supply. Consequently, the maximum peak power of the magnetron becomes large and the magnetron lifetime is shortened. And the microwave input to the discharge lamp is in ripple state. The maximum peak input of microwave is large. The discharge lamp lifetime is shortened. The lifetime of the magnetron and the discharge lamp is extended when the lamp is driven with ripple-free DC power supply.

DC driven magnetron has advantages as above. On the other hand, there is also a fault that abnormal oscillation tends to occur. An abnormal state may occur suddenly even if magnetron drive power is stable and a discharge lamp is also at steady state when ripple-free DC power is applied. A magnetron oscillation frequency and a magnetron output are varying according to reflective wave amplitude and phase. This situation is expressed with a Rieke diagram for each magnetron. When sudden abnormal operation arises in a magnetron, the magnetron does not return to the normal state of stable operation because an anode voltage does not reach zero since DC power is supplied. This is not a desirable state for a magnetron and a discharge lamp. In the case of a UV radiation discharge lamp used in a production line, it is needed to suppress discontinuation of working by rapid returning to the steady state as much as possible at the early stage after occurrence of the abnormal state. It is also demanded to return to the stable luminescence state before damaging the discharge lamp. To avoid the abnormal oscillation of a magnetron, high-voltage magnetron drive power is stopped periodically or a magnetron is stopped temporarily when an abnormal state is detected.

And, a magnetron heats up itself by reflective waves and it damages if the luminescence medium in the microwave excitation electrodeless discharge lamp evaporates inadequately right after the lighting start. In order to prevent this, the starting period after the lighting start is extended longer than the time for the luminescence medium to absorb microwave and to evaporate fully. That is, the magnetron is driven with ripple-free DC power, and at the start period immediately after lighting start, the magnetron power is increased according with evaporation of luminescence medium in order to ensure the longer starting period than that for the luminescence medium to absorb microwave and fully evaporate. This is known as a soft start of an electrodeless discharge lamp system. Some examples of conventional technology relevant to the solution for abnormal oscillation of a magnetron are cited as below.

A high-frequency heating apparatus as disclosed in the patent document 1 is that to prevent the damage of a magnetron and the other constituent parts due to unstable oscillation or moding, and at the same time to increase reliability of detecting the unstable oscillation. At the time of moding of a magnetron, it is detected by a current detection circuit to cut off the ON signal of an inverter circuit by a control circuit. And when heating is started, control based on an input from a current detection circuit is stopped for a certain period of time or a magnetron current detecting function is stopped until the level value of a current feedback means reaches a certain value.

Detection of abnormality of a magnetron as disclosed in the patent document 2 is a method to detect the abnormal oscillation of a magnetron with regard to a high frequency heater using the magnetron energized by an inverter power source. An input current detection means detects the current input into an inverter power source. An abnormal oscillation detection means detects moding, i.e. abnormal action of a magnetron. Abnormal oscillation of the magnetron can be detected by comparing the current input into the inverter power source and the reference value of the abnormal oscillation detection means with one another.

An electrodeless lamp system as disclosed in the patent document 3 is that to prevent the break due to self-heating of a magnetron by a reflected wave. By an electromagnetic field of a microwave generated by a magnetron, a luminescence medium sealed inside the electrodeless lamp is excited to emit light. This is provided with a soft starter means in which an electric power to drive the magnetron is gradually increased. This soft starter means is that which is to prevent the break due to the self-heating of the magnetron by the reflected wave, and used at the start of the light-emission of the electrodeless lamp.

A high-frequency heating device as disclosed in the patent document 4 is that to prevent a magnetron from continuing actions in a state of moding oscillation, and prevent lifetime deterioration of the magnetron. A moding oscillation detecting means detects that the magnetron is making the moding oscillation. An inverter circuit is stopped or restarted based on this information. Using the moding oscillation detecting means, the continuation of the moding oscillation of the magnetron can be prevented. A high-frequency heating device with a DC power supply such as a battery can be realized without damaging the lifetime of the magnetron.

A magnetron driving power source device as disclosed in the patent document is that to drive a magnetron by using a simple circuit configuration without installing an abnormality detecting circuit. A high voltage generating means generates a high voltage to drives the magnetron. A stop signal generating means generates a stop signal to stop the operation of the high voltage generating means at predetermined intervals only for a short period when the magnetron can be stopped. The high voltage generating means stops high voltage generation in response to the stop signal from the stop signal generating means.

[Patent document 1] JP05-251174A (1993)
[Patent document 2] JP07-014672A (1995)
[Patent document 3] JP2003-068490A
[Patent document 4] JP2003-100440A
[Patent document 5] JP2004-200051A

DISCLOSURE OF THE INVENTION

Figure 1:
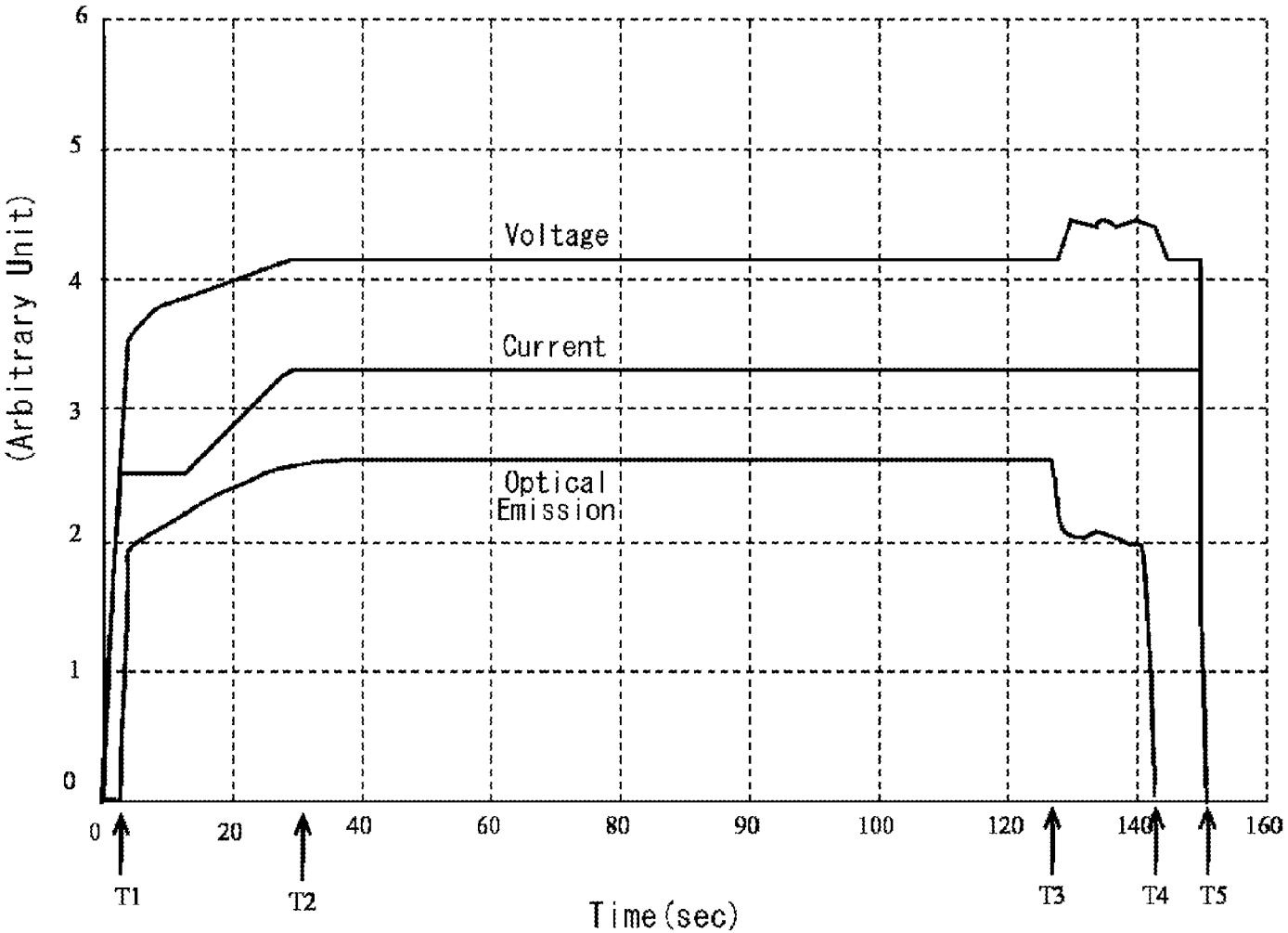
FIG. 1 It is the time chart of the lamp puncturing experiment for confirming the method of lighting the electrodeless discharge lamp in the embodiment of this invention.

Problem to be Solved by the Invention

But there are following problems in the above-mentioned conventional method to drive a magnetron with DC power. The abnormal state of a magnetron tends to occur within 1 minute immediately after the lighting start of an electrodeless discharge lamp. It damages a discharge lamp or a magnetron. As a resonator is connected to the magnetron for turning on an electrodeless discharge lamp, the operating characteristics of that magnetron differs from that of the magnetron for microwave heating. Therefore, the method as it is to prevent the abnormal oscillation of magnetron for microwave heating is inapplicable to the magnetron for a discharge lamp. Immediately after the lighting start and in the middle of decreasing or increasing light, the abnormal oscillation cannot easily be detected because drive current and applied voltage of the magnetron change and the microwave reflected from the discharge lamp also changes.

The object of this invention is, solving the above-mentioned existing problems, to prevent continuation of abnormal state occurring immediately after the lighting start of an electrodeless discharge lamp ignited by a DC driven magnetron.

Means to Solve the Problem

In order to solve the above-mentioned problem, the following method is employed in this invention. It is the lighting method of an electrodeless discharge lamp to drive the electrodeless discharge lamp in a resonator with a microwave generated by a magnetron supplied with high-voltage DC power converted from AC power. In this method, at a start period from beginning of supply of the high-voltage DC power until discharge stabilization of the electrodeless discharge lamp, the high-voltage DC power is supplied as increasing gradually and the supply of the high-voltage DC power is stopped repeatedly. At a stabilized period after discharge stabilization of the electrodeless discharge lamp, when an abnormal voltage of the high-voltage DC power is sensed, the supply of the high-voltage DC power to the magnetron is stopped momentarily.

It is determined that an abnormal state has occurred when an electrode voltage of the magnetron is detected rising 1% or more above a regular value at the stabilized period. At the start period, the high-voltage DC power is increased gradually and held evenly, and is increased gradually again. The supply stop period of the high-voltage DC power is shorter than an application period of the high-voltage DC power. A supply stop period of the high-voltage DC power is in a range from 0.1 ms to 20 ms. At the start period, the supply of the high-voltage DC power is stopped repeatedly in a fixed cycle or with irregular intervals. At dimming of light, the high-voltage DC power is gradually decreased and also the supply of the high-voltage DC power is stopped repeatedly. At return of dimming of light, the high-voltage DC power is gradually increased and also the supply of the high-voltage DC power is stopped repeatedly.

Advantages of the Invention

The steady state of continuous lighting is available without continuous abnormal state as the power supply to drive a magnetron is controlled as mentioned above. The lifetime of the discharge lamp is extended almost twice since ON/OFF operations are almost restricted only to the start period compared with the conventional lighting method.

MOST PREFERABLE EMBODIMENT OF THE INVENTION

Hereafter, the most preferable embodiment of this invention is explained in detail referring to FIGS. 1-6.

Embodiment

The embodiment of this invention is a method of lighting an electrodeless discharge lamp in the way to increase high-voltage DC power supply gradually at the start period, to stop momentarily high-voltage DC power supply repeatedly, and to stop momentarily high-voltage DC power supply to the magnetron when an abnormal voltage of high-voltage DC power is detected at a stable discharging period.

Figure 2:
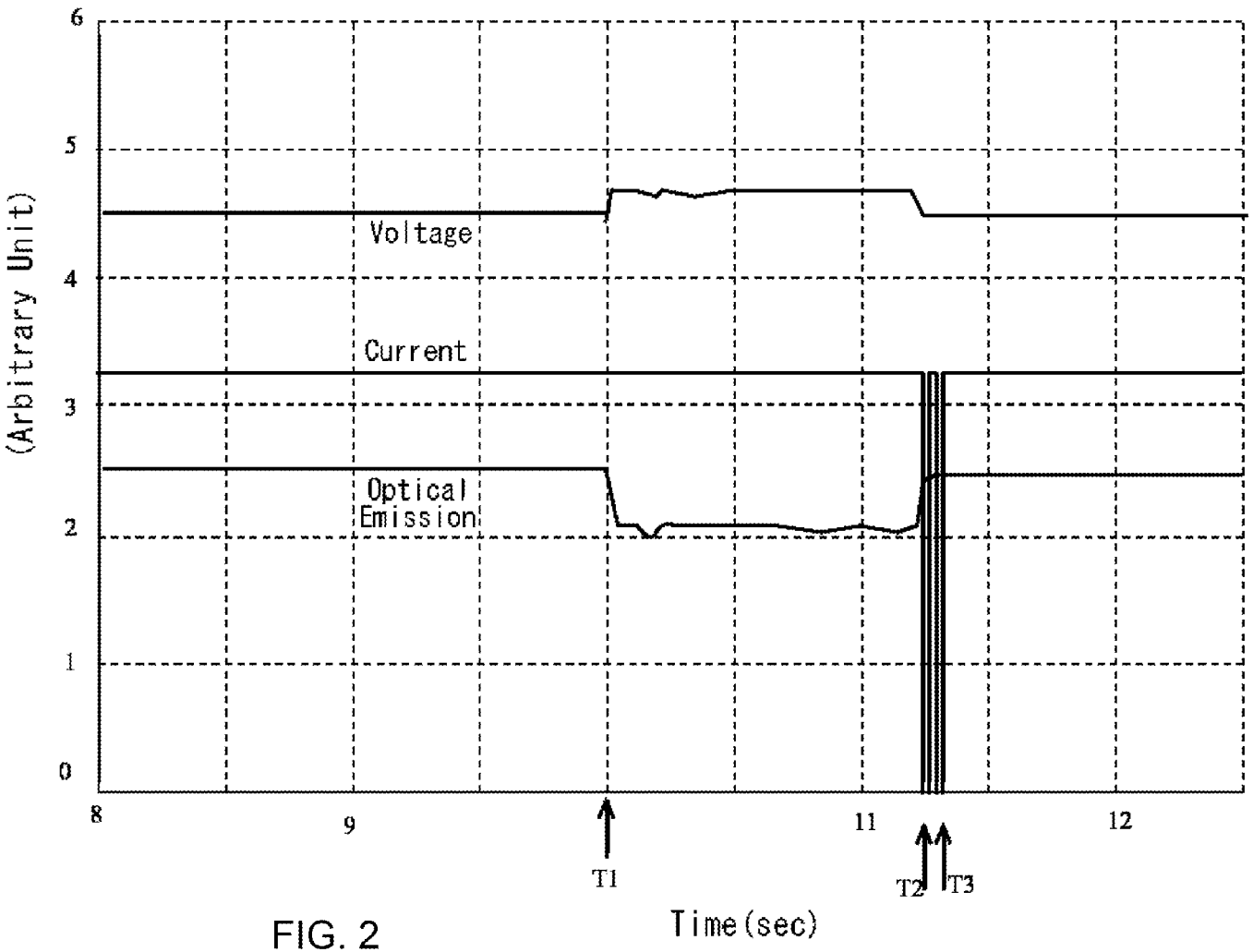
FIG. 2 It is the time chart of the effect check experiment of the method of lighting the electrodeless discharge lamp of the embodiment of this invention.
Figure 3A:
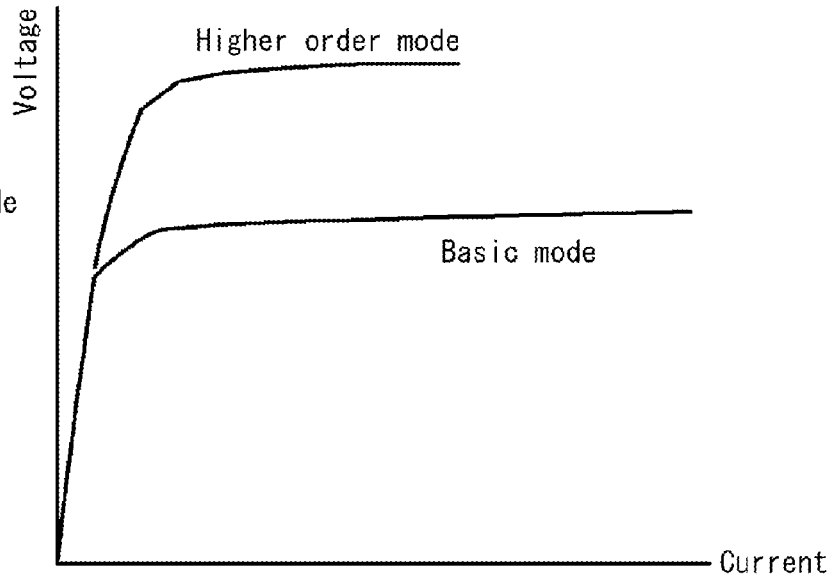
FIG. 3 It is the diagram of the magnetron operation mode used in the method of lighting the electrodeless discharge lamp of the embodiment of this invention.
Figure 3B:
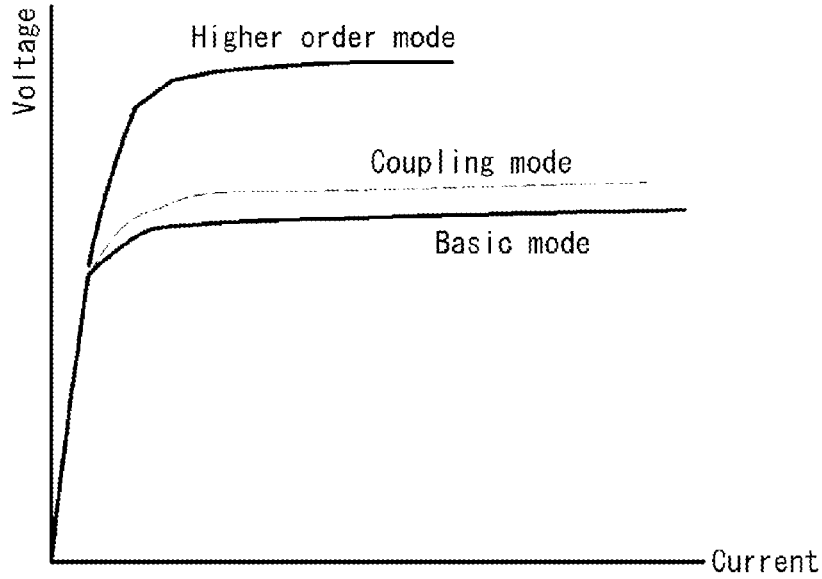
Figure 3C:
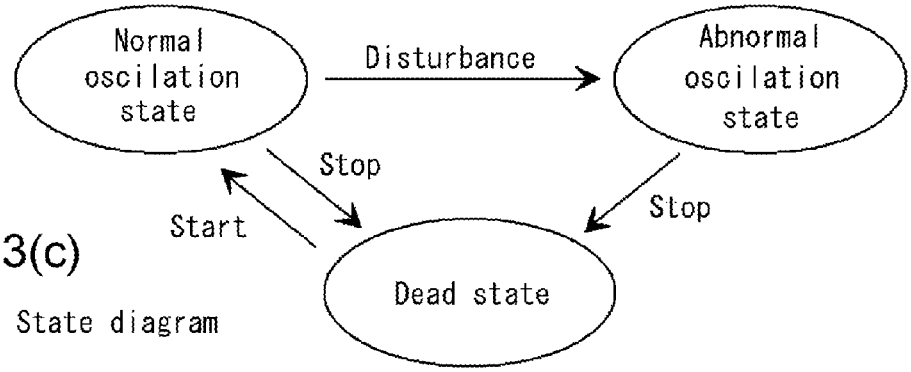

FIG. 1 is the time chart of the lamp puncturing experiment for checking the method of lighting an electrodeless discharge lamp in the embodiment of this invention. FIG. 2 is the time chart of an effect check experiment of the method of lighting electrodeless discharge lamp. FIG. 3 is a diagram of a magnetron operation mode.

Figure 4:
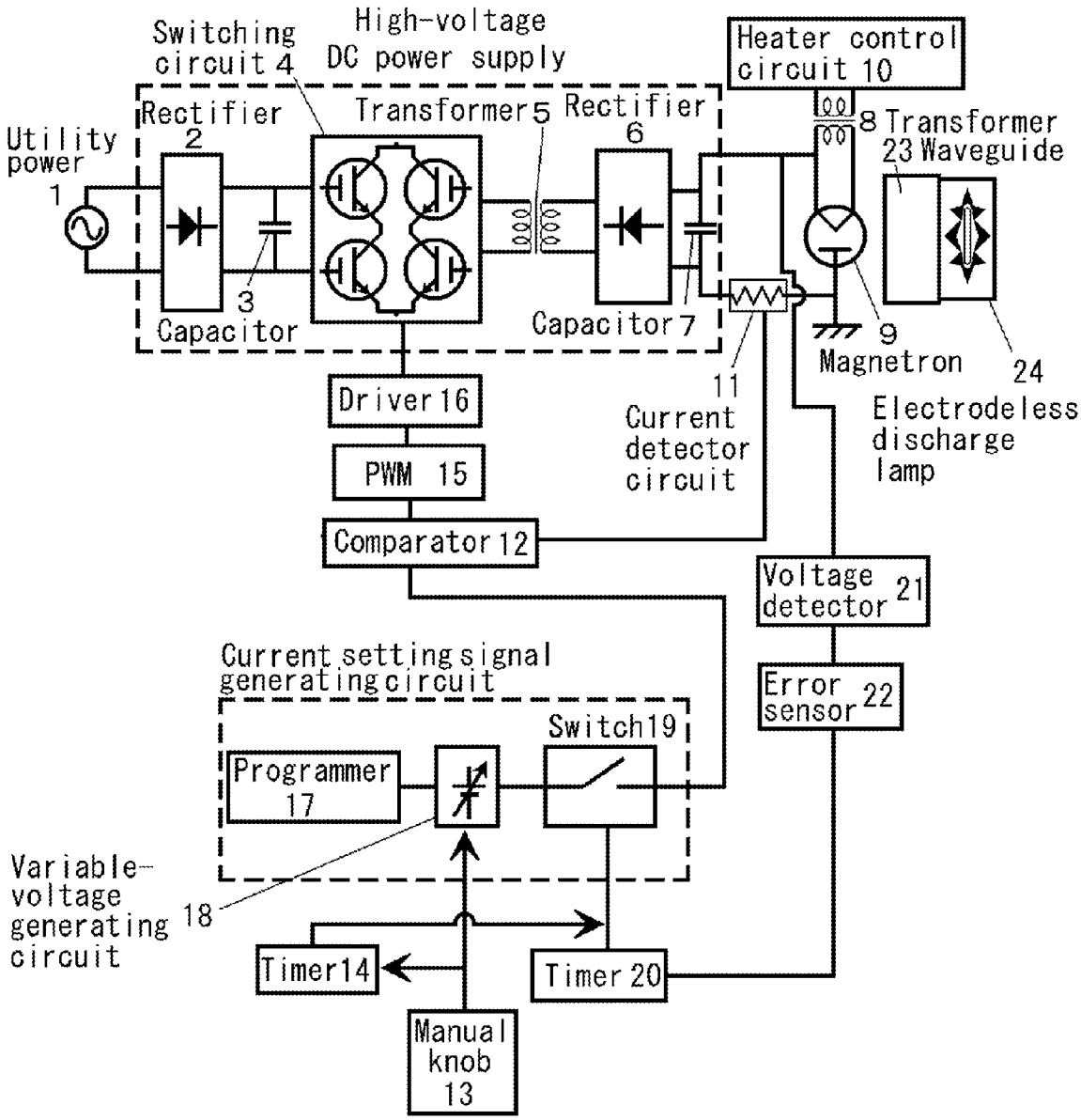
FIG. 4 It is the functional block diagram of the lighting equipment to perform the method of lighting the electrodeless discharge lamp of the embodiment of this invention.

FIG. 4 is a functional block diagram of the lighting equipment to employ the method of lighting electrodeless discharge lamp in the embodiment of this invention. In FIG. 4, the utility power 1 is AC power in 50 Hz or 60 Hz. A rectifier 2 is a means to change AC to ripple current. A capacitor 3 is a smoothing means to change a ripple current into low ripple DC. A switching circuit 4 is a circuit to transform DC into pulse current. A transformer 5 is a means to raise voltage to change pulse current to high-voltage AC. A rectifier 6 is a means to change high-voltage AC into high-voltage ripple current. A capacitor 7 is a smoothing means to change high-voltage ripple current into high-voltage low-ripple DC.

A transformer 8 is a means to vary the voltage of the heater current of a magnetron and also to insulate a heater control circuit with a heater. A magnetron 9 is an electron tube oscillating to generate microwave. The heater control circuit 10 is a means to control the heater current of a magnetron. The current detector circuit 11 is a circuit to detect the anodal current of a magnetron. The comparator 12 is a means to compare the anodal current with the preset value of a magnetron. The manual knob 13 is an operation knob for setting up magnetron drive voltage manually. A timer 14 is a means to generate the timing signal for controlling the current setting signal by turning on or off.

The Pulse-Width-Modulation circuit (PWM) 15 is a circuit to control the pulse width according to the output of the comparator so that pulse width turns into regular width of ON and OFF. A driver 16 is an element to drive a switching circuit. A programmer 17 is a means to set up drive voltage. The variable voltage generating circuit 18 is a circuit to generate voltage according to a programmer or a manual knob. A switch 19 is a means to carry out ON and OFF of the setting voltage according to a timer. A timer 20 is a means to decide the timing to turn off a magnetron. The voltage detector 21 is a means to detect the cathode voltage of a magnetron. The error sensor 22 is a means to detect abnormalities according to the cathode voltage of a magnetron. A waveguide 23 is a means to conduct the output microwave of a magnetron to a resonator.

Figure 5:
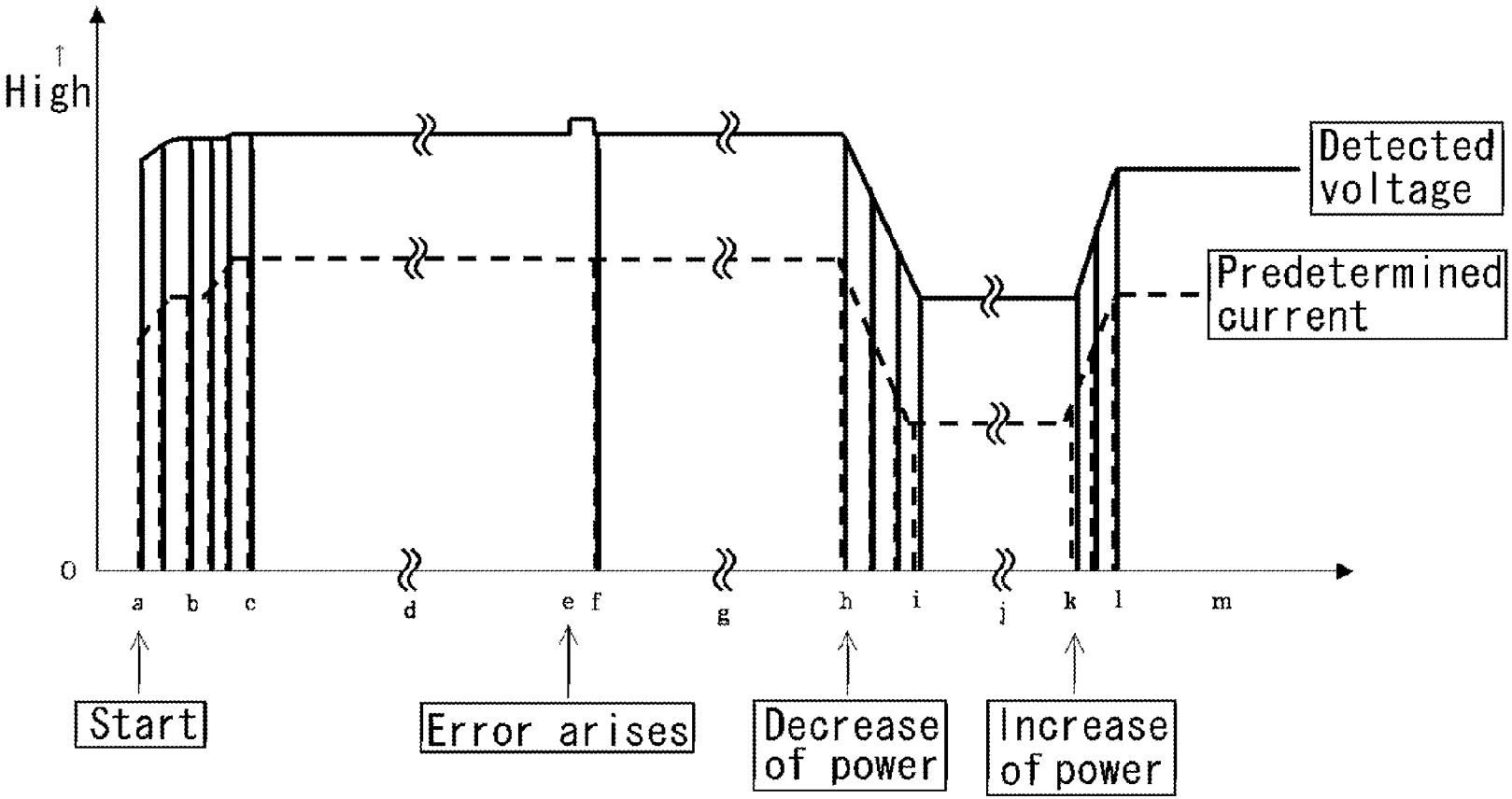
FIG. 5 It is the time chart to illustrate the method of lighting the electrodeless discharge lamp of the embodiment of this invention.
Figure 6:
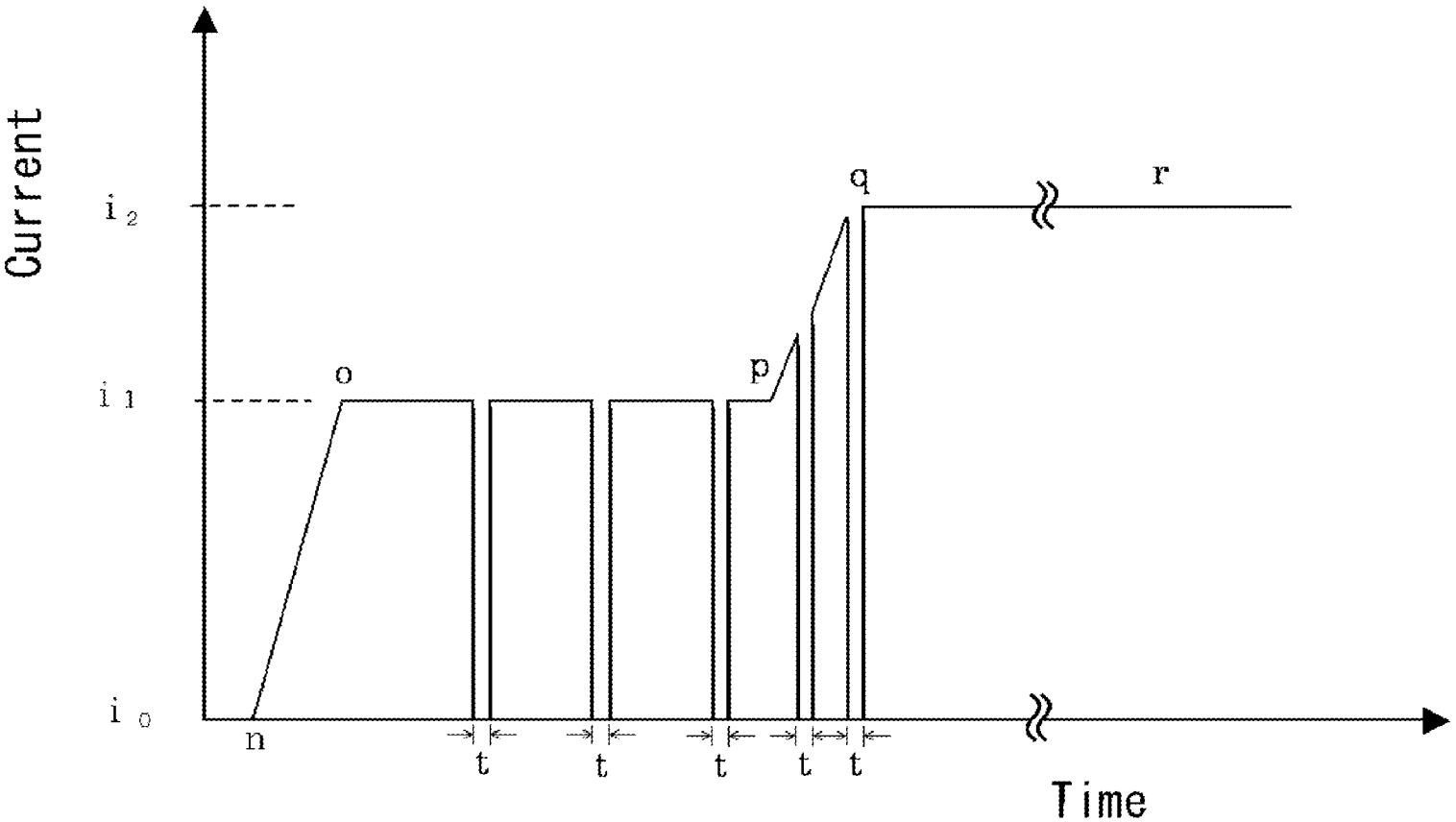
FIG. 6 It is a time chart to illustrate the control method at the start period of the method of lighting the electrodeless discharge lamp of the embodiment of this invention.

FIG. 5 is a time chart explaining the method of lighting an electrodeless discharge lamp. FIG. 6 is a time chart explaining the control procedure at the start period in the method of lighting an electrodeless discharge lamp.

Here is explained the principle and the procedure of operation in the method of lighting an electrodeless discharge lamp of the embodiment of this invention constituted as mentioned above. First, the principle of the method of turning on an electrodeless discharge lamp stably is explained. In the lighting apparatus combined with a magnetron, a waveguide, a resonator, an antenna and a discharge lamp, the response behavior to the oscillation frequency change is rather complicated. If the magnetron oscillation frequency changes, a waveguide connected to an electrodeless discharge lamp, an antenna and a resonator will vary the amplitude and the phase of microwave. That is, if oscillation frequency changes, the amplitude and the phase of a reflective wave will change, and the oscillation frequency of a magnetron will change under that influence. As a result, a reflective wave will become strong further, oscillation frequency will change further, and the magnetron state will change into the state of larger reflection. For example, according to external factors such as garbage, dust, dew condensation or water drop, the electric discharge state in a discharge lamp may be disturbed, and a discharge lamp may be in an abnormal state. The strong reflective wave from the discharge lamp at stable magnetron drive power will turn the magnetron in the abnormal state and the state will be kept for a long time.

The discharge lamp will absorb all the microwave power from the magnetron when the cavity resonator, the antenna and the discharge lamp are coupled appropriately. However, the coupling between the antenna and the discharge lamp is not stable for such a high power microwave as 6 kW (one side 3 kW) since electric property changes sharply before and after the discharge start. Intensive reflective wave influences the magnetron highly before the lamp discharge start. After the discharge starts and becomes stable, the reflective wave is weak and the magnetron operates stably. Microwave absorption is a little before discharge starts and unabsorbed microwave returns to the magnetron as reflective wave. The discharge start changes the discharge gas into a conductor to absorb microwave and then the reflective wave to return to the magnetron decreases.

The soft start makes the magnetron current begin to flow on gradual increase causing the microwave power and the reflective wave also to grow gradually. Depending on the amplitude and the phase of this reflective wave, the magnetron oscillation state may fall in the abnormal state greatly away from the rated state and keep that state. The discharge start changes the magnetron current and voltage a lot and then the magnetron tends to approach the abnormal stable point. In this abnormal oscillation state far from rated frequency, the microwave distributions in both of the resonator and the antenna may be disturbed and unusually strong standing wave may occur. In such a case, microwave power concentrates on a particular part of the discharge lamp to be heated unusually and the discharge lamp may be damaged.

The magnetron is controlled as follows in order to avoid the lamp breakage by the abnormal magnetron oscillation at the lighting start. The DC driven magnetron is started in soft start mode. In order to avoid the abnormal operating state with strong reflective wave kept for a long time when microwave is irradiated to the discharge lamp, such recovery operation is repeated that the abnormal operating state is reset by way of turning off the output of the DC power supply for a short time. After that, the stable DC power is supplied and also the magnetron anode current is controlled at a fixed value. When the rise is detected at the discharge lamp operation voltage, the DC power supply output is turned off momentarily to recover the steady state. Furthermore, the magnetron is repeatedly stopped momentarily to avoid the duration of the abnormal state both of the magnetron and the discharge lamp for about 30 seconds after the beginning of increase and decrease of magnetron drive power.

The abnormal state is decided to occur when the magnetron electrode voltage is detected to rise 1% or more above the regular value at the steady state period. The high-voltage DC power is increased gradually at the start period then held evenly and increased gradually again. Duration of high-voltage DC power supply stop is made shorter than the application time of high-voltage DC power. Duration of high-voltage DC power supply stop is set in the range from 0.1 msec to 20 msec. High-voltage DC power supply at the start period is stopped repeatedly at a fixed cycle or irregular intervals. High-voltage DC power at the dimming period is decreased gradually and also stopped repeatedly. High-voltage DC power at the returning period from dimming is increased gradually and also stopped repeatedly. This procedure is developed according to the result of the experiment to confirm the cause of the abnormal magnetron oscillation and the validity of the solution for it.

Next, referring to FIG. 1, here is explained the experiment to cause forcefully abnormal operation in a lighting apparatus of microwave excitation discharge lamp. Abnormal operation means that to open a hole at the specific part of the lamp. The clear cause of this phenomenon is unknown. Always the same hole can be repeated to open by the experiment to put a wire near the stable lighting lamp. Drive current and voltage of the magnetron and the optical lamp power are changing in this experiment as shown in FIG. 1. The time symbols from T1 to T5 are marked on the time-axis of FIG. 1.

Power supply is started at T1 to begin discharge and then optical power rises. T1-T2 is a soft start period. Magnetron drive current is temporarily held at the level lower than the rated current and then is increased to the rated current. At this time, magnetron voltage rises and optical power also increases. Discharge is stabilized at the time of T2. Stable lighting continues for T2-T3. A wire is put near the lamp at T3. Discharge state is disturbed and the optical power decreases for T3-T4. Magnetron drive current is kept at the predetermined current at this time and the voltage rises about 200V with changing a little.

A hole opens on the lamp at T4, discharge stops and optical power turns to 0. Then, voltage returns to the steady state. The length until lamp hole opening after wire insertion varies according to the way of wire insertion. Magnetron drive current and voltage return to the steady state after the discharge stop at T5. But the security circuit stops the magnetron forcedly as the optical power turns to 0.

Next, referring to FIG. 2, here is explained the result of the experiment to stop magnetron drive temporally. Lighting is stable until T1. A wire is inserted at T1 then discharge turns to unstable and the voltage rises. After about 1 second progress, the pulse modulation circuit is operated to stop the magnetron momentarily. Then, the magnetron voltage and the optical power recover to maintain stable lighting.

This result leads to the conclusion as follows. A wire is inserted near the lamp and then the wire passes along the neighborhood of the lamp. The cooling air blows the wire to go away from the lamp. The flown wire is positioned where it does not disturb the discharge originally. The wire passing by the lamp disturbs the microwave distribution greatly to disturb the discharge. This disturbance triggers the disorder of the discharge state. This disordered state continues after the absence of the wire. A momentary magnetron stop resets the continuous disordered discharge state to recover the steady state.

Next, referring to FIG. 3, the coupling mode of magnetron is explained. The magnetron consists of a cathode, an anode and a magnet inside. A cavity resonator is formed at the anode. High voltage (4-5 kV) is applied between the cathode and the anode in order to accelerate electrons. The magnetic field deflects the electrons emitted out of the cathode on the way to the anode. In this way, electromagnetic wave (microwave) is generated. The resonator built in the anode enables the magnetron to oscillate efficiently at single frequency. The magnetron can oscillate in higher order mode with different phases among the plural (about ten) resonators formed in the anode. However, the higher order mode oscillation may not usually take place because the higher order oscillation needs higher voltage than in basic mode by about 1000 V. FIG. 3(*a*) shows the voltage-to-current graph of this situation. Transition to the higher order mode of little current and high voltage may occur in the magnetron when the cathode current does not fully flow because of magnetron filament degradation or insufficient heating power. This phenomenon is known as moding.

The reason of abnormal state continuance is presumed as follows. Microwave is derived from the magnetron through waveguide to supply to a load resonator for the electrodeless discharge lamp. The coupling of this load resonator and the magnetron resonator may cause the magnetron to oscillate in the mode different from the basic mode. Such mode is to be called coupling mode here. This is the same as the phenomenon that strongly coupled resonators have the resonant point different from each resonance frequency.

The coupling mode oscillation is hard to take place in usual since the coupling mode needs higher voltage than normal mode as shown in FIG. 3 (*b*). However, the reflective wave of the basic mode frequency may increase depending on the resonance state of the load resonator to cause the magnetron unstable. Then the magnetron turns into the coupling mode of higher voltage and keeps the state. This coupling mode is considered to exist in case that the load is the resonator with a discharge lamp. The reflective wave of the basic mode frequency increases in response to the turbulence by the wire insertion. The magnetron turns from the basic mode into the coupling mode to keep in that state as the coupling mode is more stable than the basic mode on this condition. The situation of this state transition is shown briefly in FIG. 3(*c*).

Next, referring to FIG. 4, here is explained the operation of an electrodeless discharge lamp lighting equipment. The rectifier 2 rectifies the current of the utility power 1 and the capacitor 3 smoothes the rectified current to supply as the DC power. The semiconductor switching circuit 4 changes the DC power into the AC power about in 20 kHz. The transformer 5 raises this AC power in voltage and the rectifier 6 rectifies the AC power to the rippled DC power. The capacitor 7 makes the rippled DC power smooth to yield the high-voltage DC power. This DC power is supplied to the magnetron 9. The transformer 8 supplies the heating power for the heater and the heater control circuit 10 controls the heating power. In addition, the circuit from the rectifier 2 to the capacitor 7 is called the high-voltage DC power supply in this embodiment. The microwave generated by the magnetron 9 is supplied to the waveguide 23 to ignite the discharge lamp 24 in the cavity resonator.

The output voltage of the variable voltage generating circuit 18 is changed by the instruction output of the programmer 17. The programmer 17 is prepared for maintaining the anodal current of the magnetron 9 at the predetermined value.

Moreover, the current value detected by the current detector circuit 11 is converted into the value in voltage and it is supplied to the comparator 12. The comparator 12 compares the measurement voltage value with the variable voltage value. The measurement voltage value is the value converted in voltage based on the current obtained from the current detector circuit 11. The variable voltage value is supplied through the switch 19 from the variable voltage generating circuit 18. The Pulse-Width-Modulation circuit (PWM) 15 controls the switching circuit 4 based on this comparison result through the driver 16. The voltage is regulated to supply to the magnetron 9 in this way.

The timer 14 controls ON/OFF of the current setting signal with generating the timing signal to turn on or off the current setting signal. The timer 14 may generate the proper control signal with a timer IC composed of a one-shot timer circuit and a self-excited oscillator or with a programmable controller (PLC) etc.

The programmer 17 instructs the variable voltage generating circuit 18 at the discharge start of the electrodeless discharge lamp to yield the output voltage to control the gradual increase of the magnetron power at the predetermined period. That is, this output voltage is supplied to the switching circuit 4 through the comparator 12, PWM 15 and the driver 16. The width of them is gradually changed so as to extend the ON-time of the control element (transistor). The magnetron power (voltage, current) increases as a result.

The comparator 12 commands PWM 15 to yield the regular ON/OFF width output when the magnetron anodal current rises after predetermined time up to the value equivalent to the value set in the programmer 17. Then, PWM 15 regulates the switching circuit 4 through the driver 16 to maintain the switching width at the regular width.

On the other hand, the timer 20 instructs the switch 19 to turn on and off periodically at the period until the magnetron anodal current rises up to the value set in the programmer 17. This ON-time is 100 msec and OFF-time is 2 msec for example. This periodic ON/OFF increases the power with avoiding abnormal operation to eliminate the troubles at the start period.

The voltage detector 21 detects the changed voltage when the magnetron voltage changed exceeding the predetermined value for the sake of the disordered discharge caused by the garbage or the dust for example around the discharge lamp after the magnetron and the discharge of the discharge lamp reach the stable operation state. The error sensor 22 recognizes the voltage change period of 0.5 second for example as the error to supply the error signal output to the timer 20. This error signal output drives the timer 20 to turn off the switch 19. The turn-off time is 1 msec, for example.

The switching circuit 4 is turned off during this 1 msec to intercept the power supply to the magnetron. Therefore, it can prevent the glass bulb breakage of the discharge lamp caused by the local heat rising at the discharge lamp by reason of the abnormal discharge. Moreover, it minimizes the loss time and product defect caused by the stop of the discharge lamp equipment.

And, the manual knob 13 can alter the voltage of the variable voltage generating circuit 18 when to vary the discharge lamp output power for slowing the line speed during lighting or for changing the kind of irradiated material. The timer 14 turns on the switch 19 for 1 second and off for 1 msec for example at this voltage-change period. The switching circuit 4 is cut during the OFF-period of the switch 19. Therefore, the discharge lamp never falls in the abnormal discharge state and the magnetron power supply can be changed safely.

Next, referring to the time chart of FIG. 5, there is explained the procedure of lamp lighting. The broken line shows the current preset value and the solid line shows the detected value of the applied voltage to the magnetron. The mark (a) shows the start point and the mark (c) shows the end point of the soft start period. In addition, the flat part of (b) means the standby state (when the optical intensity of the electrodeless lamp is below the preset value) of the soft start period, and it shows a flat electric power supply. The current preset value is increased gradually and simultaneously the power is turned on and off periodically at this soft start period to increase the applied power to the magnetron gradually. After this soft start period, the magnetron oscillation and the discharge at the discharge lamp become fixed to enter the steady state period (d). If the magnetron abnormal oscillation and discharge disorder of the lamp occur suddenly at the steady state period (d) and the magnetron applied voltage rises at the time (e), holds for 0.5 second at the time (f), the timer turns off the preset current value for 1 msec to cut the magnetron power supply. Then, the state is recovered to the continuous steady state period (g).

In order to alter the discharge lamp illumination up or down, the output to the magnetron is changed in the operation as follows for example. At the time of (h) in the steady state period (g), the manual knob 13 directs the timer and the switch to lower the output to the magnetron gradually to the predetermined value at the time of (i) while the switching circuit is cut periodically. Then the steady state is reached at the time (j). Also in order to increase the output to the magnetron, the manual knob 13 directs the timer and the switch to raise the output to the magnetron gradually to the predetermined value at the time of (I) while the switching circuit is cut periodically. Then the steady state is reached at the time of (m).

Next, referring to FIG. 6, the soft start method is explained. FIG. 6 shows the magnetron current value by the programmer from the soft start period to the steady state (rating). The photo sensor installed in the equipment detects the photo intensity of the electrodeless discharge lamp 24, i.e., the evaporation state of the luminescence medium enclosed in the electrodeless discharge lamp 24 at the time point of (o) at 60% of full power input to the magnetron, for example. That photo intensity is examined whether it is above the predetermined optical intensity.

When the photo intensity of the electrodeless discharge lamp 24 is below the predetermined optical intensity on the way of the operation of the soft start, the current is kept constant (i1) and the power increasing is stopped to stand by for the rising-up of the electrodeless discharge lamp 24. And when the photo intensity surpasses the predetermined optical intensity, the magnetron power is increased gradually (from (p) to (q)) as the current is increased (from (i1) to (i2)), namely, the input power is increased (raised). After that, the magnetron is operated at rating.

In addition, the reflective wave is small and the magnetron is stabilized more at the period from (n) to (q) since the magnetron output is set up at a low value. Moreover, the normal magnetron operation current (i2) can be ensured by way that the magnetron in abnormal state is forced to recover the normal state by stopping the magnetron at the period (t) periodically. High-voltage DC power may be stopped supplying repeatedly at irregular interval instead of periodical stopping. The magnetron stop period (t) is preferably from 0.1 msec to 20 msec. The discharge of the discharge lamp extinguishes if the stop period is over 30 msec.

The parameter of the soft start or the supply stop cycle of high-voltage DC power may be determined arbitrarily. But it is preferable to obtain the optimal value through experiments or simulations according to the combination of the magnetron, the load resonator and the electrodeless discharge lamp. In this way, the oscillation stability and the life can be regulated at the maximum. Moreover, in order to raise the stability in the stationary state, the load resonator should be adjusted so that the coupling mode may be kept away as much as possible from the basic mode.

As mentioned above, in the embodiment of this invention, the magnetron can recover the normal state from the abnormal state with minimum operation of turning-off and also the discharge lamp life extends since the method of lighting the electrodeless discharge lamp is constituted as to increase high-voltage DC power supply gradually at the start period, to stop momentarily high-voltage DC power supply repeatedly, and to stop momentarily high-voltage DC power supply to the magnetron when an abnormal voltage of high-voltage DC power is detected at a stable discharging period.

Industrial Applicability

The method of lighting an electrodeless discharge lamp of this invention is optimal as the method of lighting a discharge lamp for emitting intensive UV radiation.

REFERENCE SYMBOLS

1 Utility power
2 Rectifier
3 Capacitor
4 Switching circuit
5 Transformer
6 Rectifier
7 Capacitor
8 Transformer
9 Magnetron
10 Heater control circuit
11 Current detector circuit
12 Comparator
13 Manual knob
14 Timer
15 Pulse Width Modulation circuit (PWM)
16 Driver
17 Programmer
18 Variable-voltage generating circuit
19 Switch
20 Timer
21 Voltage detector
22 Error sensor
23 Waveguide
24 Electrodeless discharge lamp

The invention claimed is:

1. A method of lighting an electrodeless discharge lamp in the way to excite said electrodeless discharge lamp in a resonator using a microwave generated by a magnetron supplied with high-voltage DC power converted from AC power, comprising:

at a start period from beginning of supply of said high-voltage DC power until discharge stabilization of said electrodeless discharge lamp, supplying said high-voltage DC power as increasing gradually, and stopping repeatedly the supply of said high-voltage DC power, and at a stabilized period after discharge stabilization of said electrodeless discharge lamp, sensing for an abnormal voltage of said high-voltage DC power and when an abnormal voltage of said high-voltage DC power is sensed, stopping momentarily supply of said high-voltage DC power to said magnetron.

2. A method of lighting an electrodeless discharge lamp described in claim 1, wherein said sensing for an abnormal voltage of said high-voltage DC power is sensed when an electrode voltage of said magnetron is detected rising 1% or more above a regular value at said stabilized period.

3. A method of lighting an electrodeless discharge lamp described in claim 1, comprising, at said start period, increasing, holding evenly and increasing gradually again said high-voltage DC power.

4. A method of lighting an electrodeless discharge lamp described in claim 1, comprising, making a supply stop period of said stopping repeatedly of the supply of said high-voltage DC power shorter than an application period of said high-voltage DC power.

5. A method of lighting an electrodeless discharge lamp described in claim 4, comprising, making a supply stop period of said stopping repeatedly of the supply of said high-voltage DC power in a range from 0.1 ms to 20 ms.

6. A method of lighting an electrodeless discharge lamp described in claim 1, comprising, at said start period, said stopping repeatedly the supply of said high-voltage DC power is in a fixed cycle or with irregular intervals.

7. A method of lighting an electrodeless discharge lamp described in claim 1, comprising, at dimming of light, gradually decreasing said high-voltage DC power and also stopping repeatedly the supply of said high-voltage DC power.

8. A method of lighting an electrodeless discharge lamp described in claim 1, comprising, at return of dimming of light, gradually increasing said high-voltage DC power and also stopping repeatedly the supply of said high-voltage DC power.

9. A method of lighting an electrodeless discharge lamp excited by microwave generated by a magnetron, wherein said magnetron is supplied with a almost ripple-free high-voltage DC power, and a cavity accommodates said electrodeless discharge lamp and is coupled with said magnetron, the method comprising;

gradually increasing said high voltage DC power and momentarily and repeatedly stopping said high voltage DC power until discharge stabilization of said electrodeless discharge lamp is obtained, detecting an abnormal voltage caused by irregular coupling between said magnetron and said cavity at the stabilized period of said electrodeless discharge lamp, and momentarily stopping said high voltage DC power to said magnetron when said abnormal voltage is detected.

* * * * *